US008457933B2

(12) United States Patent
Yoo et al.

(10) Patent No.: US 8,457,933 B2
(45) Date of Patent: Jun. 4, 2013

(54) METHOD FOR PREDICTING COOLING LOAD

(75) Inventors: Seong-Yeon Yoo, Daejeon (KR); Je-Myo Lee, Daejeon (KR); Kyu-Hyun Han, Daejeon (KR)

(73) Assignees: The Industry & Academic Cooperation in Chungnam National University, Daejeon (KR); Gagyotech Co., Ltd., Daejeon (KR)

( * ) Notice: Subject to any disclaimer, the term of this patent is extended or adjusted under 35 U.S.C. 154(b) by 343 days.

(21) Appl. No.: 12/742,182

(22) PCT Filed: Nov. 12, 2008

(86) PCT No.: PCT/KR2008/006668

§ 371 (c)(1),
(2), (4) Date: May 10, 2010

(87) PCT Pub. No.: WO2009/064111

PCT Pub. Date: May 22, 2009

(65) Prior Publication Data

US 2010/0256958 A1 Oct. 7, 2010

(30) Foreign Application Priority Data

Nov. 12, 2007 (KR) ..... 10-2007-0114917

(51) Int. Cl.
*G06F 17/10* (2006.01)

(52) U.S. Cl.
USPC ..... 703/2; 700/291; 700/300

(58) Field of Classification Search
USPC ..... 703/2; 700/291, 300
See application file for complete search history.

(56) References Cited

U.S. PATENT DOCUMENTS 4,061,185 A * 12/1977 Faiczak ..... 165/48.1
4,319,461 A * 3/1982 Shaw ..... 62/93
4,942,740 A * 7/1990 Shaw et al. ..... 62/93

(Continued)

FOREIGN PATENT DOCUMENTS

JP 62141447 6/1987
JP 05040506 A 2/1993

(Continued)

OTHER PUBLICATIONS

"Lesson 30, Psychrometry of Air Conditioning Systems" Version 1 ME, IIT Kharagpur, created Jul. 3, 2006, pp. 1-17.*

(Continued)

*Primary Examiner* — Saif Alhija
*Assistant Examiner* — Kibrom Gebresilassie

(57) ABSTRACT

Disclosed is a method for predicting the cooling load for efficient operation of a heat accumulation system by obtaining a prediction function regarding outdoor air temperature and specific humidity from meteorological office data, predicting the outdoor air temperature and specific humidity by using the prediction function and the highest and lowest temperatures of the weather forecast, and predicting the cooling load based on the sensible heat load coefficient, outdoor air coefficient, sensible heat load constant, and latent heat load constant, which are obtained from the building design data. The cooling load can be predicted without using a complicated mathematical model and with no reference to past operation data regarding the target building, but solely based on four air-conditioning design values of the building and the highest and lowest temperatures of the next day, which can be easily obtained from the weather forecast of the meteorological office.

4 Claims, 4 Drawing Sheets

(a) Hourly cooling load

U.S. PATENT DOCUMENTS

| | | | | |
|---|---|---|---|---|
| 5,058,388 | A * | 10/1991 | Shaw et al. | 62/93 |
| 5,070,703 | A * | 12/1991 | Wilkinson | 62/94 |
| 5,197,537 | A * | 3/1993 | Chigira et al. | 165/291 |
| 5,963,458 | A * | 10/1999 | Cascia | 700/300 |
| 7,197,433 | B2 * | 3/2007 | Patel et al. | 702/188 |
| 7,424,343 | B2 * | 9/2008 | Kates | 700/276 |
| 7,836,712 | B2 * | 11/2010 | Sasao et al. | 62/176.6 |
| 7,841,194 | B2 * | 11/2010 | Ishida et al. | 62/176.6 |
| 7,886,556 | B2 * | 2/2011 | Fujiyoshi et al. | 62/271 |
| 8,027,742 | B2 * | 9/2011 | Seem et al. | 700/38 |
| 8,073,662 | B2 * | 12/2011 | Momose et al. | 703/5 |
| 8,096,140 | B2 * | 1/2012 | Seem | 62/186 |
| 2006/0201168 | A1 * | 9/2006 | Kates | 62/129 |
| 2007/0107450 | A1 * | 5/2007 | Sasao et al. | 62/185 |
| 2007/0180851 | A1 * | 8/2007 | Fujiyoshi et al. | 62/480 |
| 2009/0025408 | A1 * | 1/2009 | Matsui et al. | 62/176.6 |
| 2009/0064697 | A1 * | 3/2009 | Kondo et al. | 62/271 |
| 2009/0093916 | A1 * | 4/2009 | Parsonnet et al. | 700/286 |
| 2010/0025483 | A1 * | 2/2010 | Hoeynck et al. | 236/1 C |
| 2010/0236772 | A1 * | 9/2010 | Novotny et al. | 165/287 |
| 2011/0153103 | A1 * | 6/2011 | Brown et al. | 700/291 |
| 2012/0330626 | A1 * | 12/2012 | An et al. | 703/2 |

FOREIGN PATENT DOCUMENTS

| | | | |
|---|---|---|---|
| JP | 05264086 | A | 10/1993 |
| JP | 2002-267235 | A | 9/2002 |
| KR | 1020010027974 | A | 4/2001 |
| KR | 1020030041268 | A | 5/2003 |
| KR | 100753141 | B1 | 8/2007 |

OTHER PUBLICATIONS

International Search Report for PCT/KR2008/006668 filed Nov. 12, 2008.

Kang, Chang-Soo et al., "Refrigeration and Air-Conditioning," Aug. 30, 2001, pp. 369-428(Chap. 10), Bo Seong Gak, Seoul, Republic of Korea.

* cited by examiner (a) Hourly cooling load (b) Daily cooling load

METHOD FOR PREDICTING COOLING LOAD

TECHNICAL FIELD

The present invention relates to a simplified method for predicting the cooling load in advance for cooling down a building by a cooling system equipped with a heat accumulation system, so that the cooling system can be operated effectively.

BACKGROUND ART

Electric energy is supposed to be consumed right after it has been generated, because it is very difficult and expensive to store.

There is a substantial difference between the amount of electric energy consumed at day and that of at night, and the nighttime residual electric power needs to be converted to and stored in another form of energy which is to be consumed in daytime in order to improve the efficiency of energy consumption.

To fulfill the above-mentioned need, a heat accumulation system, which can store the nighttime residual electric power as cooling energy, has been developed, and introduction of this heat accumulation system can contribute to stabilization of the nationwide power demand and reduce the cost of cooling down a building.

Heat accumulation systems for storing latent heat of vaporization can be divided into those having a heat accumulator in charge of only a part of the cooling load necessary for a day (partial heat accumulation type), and those having a heat accumulator in charge of the whole daily cooling load (whole heat accumulation type).

Because the whole heat accumulation type needs to store more cooling energy, bigger coolers and more space are required compared to the partial heat accumulation type. For this reason, the partial heat accumulation type is preferred to be adopted and widely used in Korea.

Nevertheless, the partial heat accumulation type still requires a well-combined operation of coolers and accumulators according to the cooling load so that high efficiency of energy consumption can be achieved.

However, operation of the systems has entirely been dependent on the operator's experience for years. This means that, in many cases, the operator's misjudgment and inexperienced operation have wasted power and increased the operating cost. Furthermore, insufficient supply of cooling has frequently caused inconveniences and complaints of the users.

Because heat accumulation systems store the cooling energy, which is necessary during the daytime, in advance (i.e. at midnight), an accurate prediction for how much cooling energy (so called "cooling load") is needed during the daytime is indispensable. For this reason, many cooling load prediction techniques have been studied and developed.

Researches regarding the cooling load prediction for more effective operation of heat accumulation systems have mainly been conducted in Japan, which adopts a midnight electric power billing system as in the case of Korea.

Tadahiko et al. have combined a TBCM model, which is based on topology, with an ARIMA model, which is based on time-series statistics, to obtain a hybrid model, and predict the cooling load through the curve of the hybrid model. Harunori et al. have proposed a technique for predicting the cooling load based on an ARX model. Jin et al. have proposed a cooling load prediction technique, which employs an adaptive neural network to consider even unpredicted load fluctuation among input data. Nobuo et al. have compared cooling load prediction results obtained by employing the Kalman filter model, GMDH model, and neural network model to benchmarked buildings and offices in order to verify the relative prediction accuracy.

Because all of the above-mentioned prediction techniques are based on complicated mathematical and/or statistical methods, the operators without professional knowledge have difficulty in using the techniques. In addition, above techniques heavily rely on past operation data regarding the building, to which cooling load prediction is to be applied. This means that, if a building has insufficient past operation data, the above methods can hardly be applied.

DISCLOSURE OF INVENTION

Technical Problem

The present invention has been made in view of the above-mentioned problems, and the present invention provides a method for predicting the cooling load without using a complicated mathematical model and with no reference to past operation data regarding the target building, but solely based on the air-conditioning design values of the building and the highest and lowest temperatures of the next day, which can be easily obtained from the weather forecast of the meteorological office, so that various and complicated heat accumulation systems can be operated efficiently and conveniently at the lowest operation cost.

Technical Solution

In accordance with an aspect of the present invention, there is provided a method for predicting a the cooling load, the method including the steps of:

calculating a sensible heat load and a latent heat load, respectively, of solar radiation heat, conduction heat, heat caused by infiltrated outdoor air and ventilated outdoor air, internally generated heat, and other heat loads for every conditioned space of a building; and adding the calculated sensible heat load and latent heat load to predict a the cooling load, wherein the sensible heat load of the cooling load is calculated by following Equation 2, and the latent heat load of the cooling load is calculated by following Equation 3:

$$\dot{Q}_s = P_s(T_o - T_i) + \dot{m}_a(h_{io} - h_i)(1 - \epsilon_s) + C_s \quad \text{(Equation 2)}$$

wherein, $\dot{Q}_s$ is the sensible heat load, $P_s$ is a sensible heat load coefficient, $\dot{m}_a$ is an outdoor air coefficient, $C_s$ is a sensible heat load constant, $T_o$ is an outdoor air temperature, $T_i$ is an indoor temperature, $h_{io}$ is enthalpy of air at the point where indoor specific humidity meets the outdoor air temperature on a psychrometric chart, $h_i$ is enthalpy of air in an indoor condition, and $\epsilon_s$ is a sensible heat recovery ratio of introduced outdoor air;

$$\dot{Q}_l = \dot{m}_a(h_o - h_{io})(1 - \epsilon_l) + C_l \quad \text{(Equation 3)}$$

wherein, $\dot{Q}_l$ is the latent heat load, $\dot{m}_a$ is the outdoor air coefficient, $C_l$ is a latent heat load constant, $h_o$ is enthalpy of air in an outdoor air condition, $h_{io}$ is enthalpy of air at the point where indoor specific humidity meets the outdoor air temperature on the psychrometric chart, and $\epsilon_l$ is a latent heat recovery ratio of introduced outdoor air.

Advantageous Effects

With present invention, which provides a simplified method that can predict the cooling load for operation of the heat accumulation system by solely using the air-conditioning design specifications of the target building and data obtained from the meteorological office without any complicated mathematical and/or statistical methods, the operators without professional knowledge about air-conditioning systems can operate the cooling system therewith, and the present invention can be applied easily to a new building which has not past operation data of air conditioning for the building.

Furthermore, as present invention can predict the cooling load accurately and simply, one can operate the cooling system more economically and effectively.

BRIEF DESCRIPTION OF THE DRAWINGS

The foregoing and other objects, features and advantages of the present invention will become more apparent from the following detailed description when taken in conjunction with the accompanying drawings in which:

FIGS. 5 and 6 show the results of comparison between the predicted hourly cooling load and the humidity ratio and the actually measured hourly cooling load and the specific humidity, respectively, from Jul. 15 to Aug. 15, 2005; and.

BEST MODE FOR CARRYING OUR THE INVENTION

Figure 1:
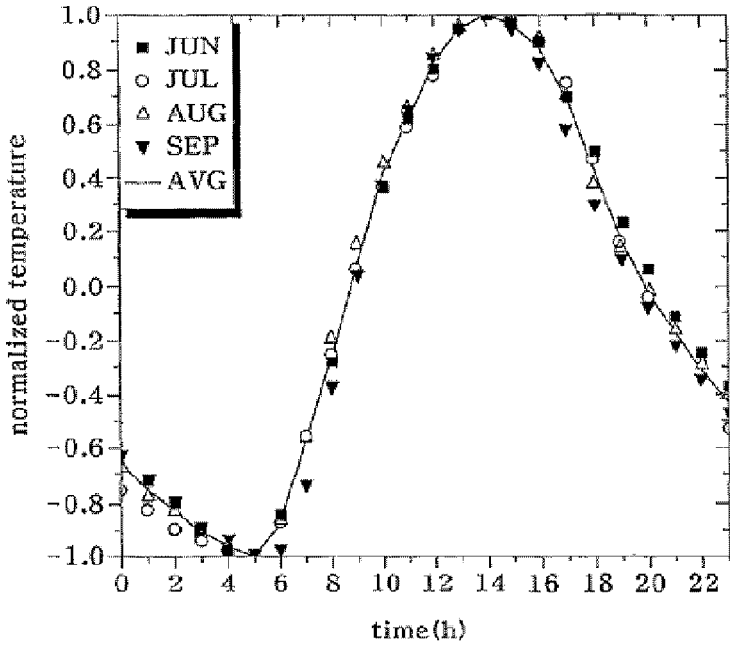
FIG. 1 is a graph showing the average outdoor air temperature in Daejeon, Korea, with the highest and lowest temperatures nondimensionalized as 1 and −1, respectively.

Prior to detailed descriptions of embodiments of the present invention, it is to be noted that details of the construction and arrangement of components described below or shown in the drawings do not limit the application of the present invention, which can be realized, implemented, and practiced in other manners.

The present invention has a technical feature which includes the steps of calculating a sensible heat load and a latent heat load, respectively, of solar radiation heat, conduction heat, heat caused by infiltrated outdoor air and ventilated outdoor air, internally generated heat, and other heat loads for every conditioned space of a building; and adding the calculated sensible heat load and latent heat load to predict a cooling load, wherein the sensible heat load of the cooling load is simplified and calculated by following Equation 2, and the latent heat load of the cooling load is calculated by following Equation 3:

$$\dot{Q}_s = P_s(T_o - T_i) + \dot{m}_a(h_{io} - h_i)(1 - \epsilon_s) + C_s \quad \text{(Equation 2)}$$

wherein, $\dot{Q}_s$ is a sensible heat load, $P_s$ is a sensible heat load coefficient, $\dot{m}_a$ is the outdoor air coefficient, $C_s$ is the sensible heat load constant, $T_o$ is an outdoor air temperature, $T_i$ is an indoor temperature, $h_{io}$ is enthalpy of air at the point where indoor specific humidity meets the outdoor air temperature on the psychrometric chart, $h_i$ is enthalpy of air in an indoor condition, and $\epsilon_s$ is a sensible heat recovery ratio of infiltrated and ventilated;

$$\dot{Q}_l = \dot{m}_a(h_o - h_{io})(1 - \epsilon_l) + C_l \quad \text{(Equation 3)}$$

wherein, $\dot{Q}_l$ is a latent heat load, $\dot{m}_a$ is the outdoor air coefficient, $C_l$ is a latent heat load constant, $h_o$ is the enthalpy of air in an outdoor air condition, $h_{io}$ is the enthalpy of air at the point where indoor specific humidity meets the outdoor air temperature on the psychrometric chart, and $\epsilon_l$ is a latent heat recovery ratio of infiltrated and ventilated air.

The present invention has another technical feature of the sensible heat load coefficient $P_s$ of the Equation 2 being calculated by following Equation 4, and the latent heat load constant being calculated by following Equation 5:

$$\dot{Q}_{s,d} = P_s(T_{o,d} - T_{i,d}) + \dot{m}_a(h_{io,d} - h_{i,d})(1 - \epsilon_{s,d}) + C_s \quad \text{(Equation 4)}$$

wherein, a design sensible heat load $\dot{Q}_{s,d}$, the outdoor air coefficient $\dot{m}_a$, the sensible heat load constant $C_s$, the outdoor air design temperature $T_{o,d}$, the indoor design temperature $T_{i,d}$, the enthalpy $h_{io,d}$ of air at the point where indoor design specific humidity meets outdoor air design temperature on the psychrometric chart, the enthalpy of air in the indoor design condition, and the design sensible heat recovery ratio $\epsilon_{s,d}$ of infiltrated and ventilated air are obtained from design specifications of the building;

$$\dot{Q}_{l,d} = \dot{m}_a(h_{o,d} - h_{io,d})(1 - \epsilon_{l,d}) + C_l \quad \text{(Equation 5)}$$

wherein, a design latent heat load $\dot{Q}_{l,d}$, the outdoor air coefficient $\dot{m}_a$, the enthalpy $h_{o,d}$ of air in an outdoor air design condition, the enthalpy $h_{io,d}$ of air at the point where indoor design specific humidity meets outdoor air design temperature on the psychrometric chart, and design latent heat recovery ratio $\epsilon_{l,d}$ of infiltrated and ventilated air are obtained from design specifications of the building.

In order to predict the hourly outdoor air temperature and specific humidity necessary to calculate temperature and enthalpy, the present invention has another technical feature which further includes the steps of setting highest and lowest temperatures of average outdoor air temperature as 1 and −1, respectively, nondimensionalizing the outdoor air temperature by using a nondimensional formula (Equation 6), and obtaining a temperature prediction function $$T^*(h) = \frac{T(h) - T_{avg}}{T_{max} - T_{avg}},\ 0 \le T^*(h) \le 1 \quad \text{(Equation 6)}$$

wherein, T*(h) is the nondimensional outdoor air temperature, T(h) is an hourly outdoor air temperature, $T_{max}$ is the highest temperature during a day, and $T_{avg}$ is an arithmetic mean of the highest and lowest temperatures;

obtaining a monthly average specific humidity from relative humidity outdoor and air temperature for each time period by using the psychrometric chart, obtaining a linear correlation formula (Equation 7) so that increase and decrease of the specific humidity is proportional to the date, and adding the Equation 7 with specified constants $C_1$ and $C_2$ and hourly specific humidity of each month to obtain a specific humidity prediction function (Equation 9) independent of month $$f(d) = C_1|d - 46| + C_2 \quad \text{(Equation 7)}$$

wherein, f(d) is a daily specific humidity correlation formula, d is the number of days starting from June 15, and $C_1$ and $C_2$ are constants determined by regional characteristics;

$$SH(h,d)=0.011-5.31E-4h+2.19E-4h^2-3.61E-6h^3+2.52E-6h^4-7.51E-8h^5+7.67E-10h^6-0.000141|d-46|+0.006375 \quad \text{(Equation 9)}$$

wherein, SH(h,d) is a hourly specific humidity correlation formula, h is a value of an hour hand of the day and d is the number of days starting from June 15;

obtaining highest and lowest temperatures of the next day from the meteorological office and the nondimensional temperature calculated from the temperature prediction function (Equation 8), substituting the highest and lowest temperatures in a prediction temperature formula (Equation 10) to obtain hourly prediction temperature during a the day $$T^*(h)=-0.94+0.46h-0.25h^2+0.04h^3-0.003h^4+1.07E-4h^5-1.29E-6h^6 \quad \text{(Equation 8)}$$

wherein, T*(h) is the nondimensional outdoor air temperature and h is a value of an hour hand of the day;

$$T_{es}(h)=T_{avg}+T^*(h)(T_{max}-T_{avg}) \quad \text{(Equation 10)}$$

wherein, $T_{es}(h)$ is the hourly prediction temperature, T*(h) is the hourly nondimensional temperature obtained from the temperature prediction function, and $T_{max}$ and $T_{avg}$ are highest and average temperatures of next day forecast, respectively; and obtaining hourly prediction specific humidity during the day from the specific humidity prediction function.

Mode for Invention

Hereinafter, exemplary embodiments of the present invention will be described with reference to the accompanying drawings.

A method for predicting the cooling load according to an exemplary embodiment of the present invention will now be described in detail with reference to FIGS. 1 to 6.

The present invention provides a cooling load prediction method that can be easily used by any person, who has no professional knowledge regarding cooling load calculation programs or cooling systems, without wasting much time to calculate the cooling load.

The cooling load consists of a sensible heat load and a latent heat load.

When one calculates the cooling load, a sensible heat load and a latent heat load from solar radiation heat which passes through glass and walls, convection heat transferred by the temperature difference between the outer and indoor air, cooling/dehumidification heat of infiltrated air and outdoor air introduced by ventilation, heat internally generated by human bodies or indoor furniture, and other heat including heat loss from air supply ducts are calculated at first, and then these are added to obtain the (total) cooling load.

The cooling load described above can be expressed mathematically by following Equation 1.

$$\dot{Q} = \dot{Q}_{sol} + \dot{Q}_{cond} + \dot{Q}_{air} + \dot{Q}_{int} = \dot{Q}_s + \dot{Q}_l \quad \text{[Equation 1]}$$

wherein, $\dot{Q}$ refers to the cooling load; $\dot{Q}_{sol}$ refers to solar radiation heat; $\dot{Q}_{cond}$ refers to conduction heat; $\dot{Q}_{air}$ refers to heat caused by infiltrated outdoor air and ventilated outdoor air; $\dot{Q}_{int}$ refers to internally generated heat and other heat loads; $\dot{Q}_s$ refers to the sensible heat load; and $\dot{Q}_l$ refers to the latent heat load.

In order to calculate the cooling load from Equation 1, above-mentioned four loads must be separately calculated for every space constituting the building and then added up. However, to calculate the four loads, one must search through enormous pieces of design data from the building design documents manually, which requires much time and manpower.

To solve above-mentioned problems, the present invention proposes a simplified method in calculating the cooling load of a building.

Considering that the sensible heat load of the cooling load consists of solar radiation heat and conduction heat, which vary depending on the temperature difference between the outer and indoor air, and the sensible heat load caused by outdoor air depends on the amount and condition of introduced outdoor air, and the internally generated sensible heat and other sensible heat loads are not sensitive to the indoor/outdoor temperature difference, the sensible heat load $\dot{Q}_s$ of the cooling load in Equation 1 can be simplified as follows.

[Equation 2]

$$\dot{Q}_s=P_s(T_o-T_i)+\dot{m}_a(h_{io}-h_i)(1-\epsilon_s)+C_s$$

wherein, $\dot{Q}_s$ is a the sensible heat load, $P_s$ is a sensible heat load coefficient, $\dot{m}_a$ is an outdoor air coefficient, $C_s$ is a sensible heat load constant, $T_o$ is an outdoor air temperature, $T_i$ is an indoor temperature, $h_{io}$ is enthalpy of air at the point where indoor specific humidity meets the outdoor air temperature on a psychrometric chart, $h_i$ is enthalpy of air in an indoor condition, and $\epsilon_s$ is a sensible heat recovery ratio of introduced outdoor air.

Based on a similar concept, the latent heat load $\dot{Q}_l$ of the cooling load in Equation 1 can be simplified in the following manner by dividing it into terms, which depend on the amount and condition of introduced outdoor air, and constant terms.

[Equation 3]

$$\dot{Q}_l=\dot{m}_a(h_o-h_{io})(1-\epsilon_l)+C_l \quad \text{(Equation 3)}$$

wherein, $\dot{Q}_l$ is the latent heat load, $\dot{m}_a$ is the outdoor air coefficient, $C_l$ is a latent heat load constant, $h_o$ is an enthalpy of air in an outdoor air condition, $h_{io}$ is the enthalpy of air at the point where indoor specific humidity meets the outdoor air temperature on the psychrometric chart, and $\epsilon_l$ is a latent heat recovery ratio of introduced outdoor air.

A design sensible heat load $\dot{Q}_{s,d}$, the outdoor air coefficient $\dot{m}_a$, and the sensible heat load constant $C_s$ are obtained from the design specifications of the building, and sensible heat load coefficient $P_s$ is obtained by substituting an outdoor air design temperature $T_{o,d}$, an indoor design temperature $T_{i,d}$, an enthalpy $h_{io,d}$ of air at the point where indoor design specific humidity meets outdoor air design temperature on the psychrometric chart, an enthalpy $h_{i,d}$ of air in the indoor design condition, and a design sensible heat recovery ratio $\epsilon_{s,d}$ in following Equation 4.

[Equation 4]

$$\dot{Q}_{s,d}=P_s(T_{o,d}-T_{i,d})+\dot{m}_a(h_{io,d}-h_{i,d})(1-\epsilon_{s,d})+C_s$$

wherein, the design sensible heat load $\dot{Q}_{s,d}$, the outdoor air coefficient $\dot{m}_a$, the sensible heat load constant $C_s$, an outdoor air design temperature $T_{o,d}$, an indoor design temperature $T_{i,d}$, an enthalpy $h_{io,d}$ of air at the point where indoor design specific humidity meets outdoor air design temperature on the psychrometric chart, the enthalpy $h_{i,d}$ of air in the indoor design condition, and the design sensible heat recovery ratio $\epsilon_{s,d}$ of infiltrated and ventilated air are obtained from design specifications of the building.

Similarly, a design latent heat load $\dot{Q}_{l,d}$ and the outdoor air coefficient $\dot{m}_a$ are obtained from the design specifications of the building, a latent heat load constant $C_l$ is obtained by substituting the enthalpy $h_{o,d}$ of air in the outdoor air design condition, enthalpy $h_{io,d}$ of air at the point where the indoor design specific humidity meets the outdoor air design temperature on the psychrometric chart, and design latent heat recovery ratio $\epsilon_{l,d}$ of infiltrated and ventilated air in following Equation 5.

[Equation 5]

$$\dot{Q}_{l,d}=\dot{m}_a(h_{o,d}-h_{io,d})(1-\epsilon_{l,d})+C_l$$

wherein, the design latent heat load $\dot{Q}_{l,d}$, the outdoor air coefficient $\dot{m}_a$, the enthalpy $h_{o,d}$ of air in the outdoor air design condition, the enthalpy $h_{io,d}$ of air at the point where the indoor design specific humidity meets the outdoor air design temperature on the psychrometric chart, and the design latent heat recovery ratio $\epsilon_{l,d}$ of infiltrated and ventilated air are obtained from design specifications of the building.

Meanwhile, it is also possible to obtain the latent heat load constant $C_1$ directly from the design specifications of the building.

As shown in Equations 2 and 3, the cooling load of the building varies depending on weather conditions (e.g. outdoor air temperature, specific humidity), and prediction of the cooling load of the next day must be preceded by prediction of the outdoor air temperature and specific humidity of the next day.

Present inventors have analyzed weather data for each time period from June to September of the last five years to obtain standardized prediction functions regarding the outdoor air temperature and specific humidity. The obtained prediction function is used to predict the outdoor air temperature and specific humidity for each time period solely based on the highest and lowest temperatures, which are always forecasted by the meteorological office.

FIG. 1 is a graph showing the average outdoor air temperature for each month from July to September for five years of 2001-2005 in Daejeon, Korea, which is obtained by going through the steps of setting highest and lowest temperatures of average outdoor air temperature as 1 and −1, respectively, and nondimensionalizing the outdoor air temperature by using a nondimensional formula (Equation 6).

[Equation 6]

$$T^*(h)=\frac{T(h)-T_{avg}}{T_{max}-T_{avg}},\ 0\le T^*(h)\le 1 \qquad \text{(Equation 6)}$$

wherein, T*(h)is the nondimensional outdoor air temperature, T(h) is the hourly outdoor air temperature, $T_{max}$ is the highest temperature during the day, and $T_{avg}$ is arithmetic mean of the highest and lowest temperatures;

It is clear that each month has a regular pattern of temperature change for a day, i.e. the highest and lowest values appear at 14:00 and 5:00, respectively.

Figure 2:
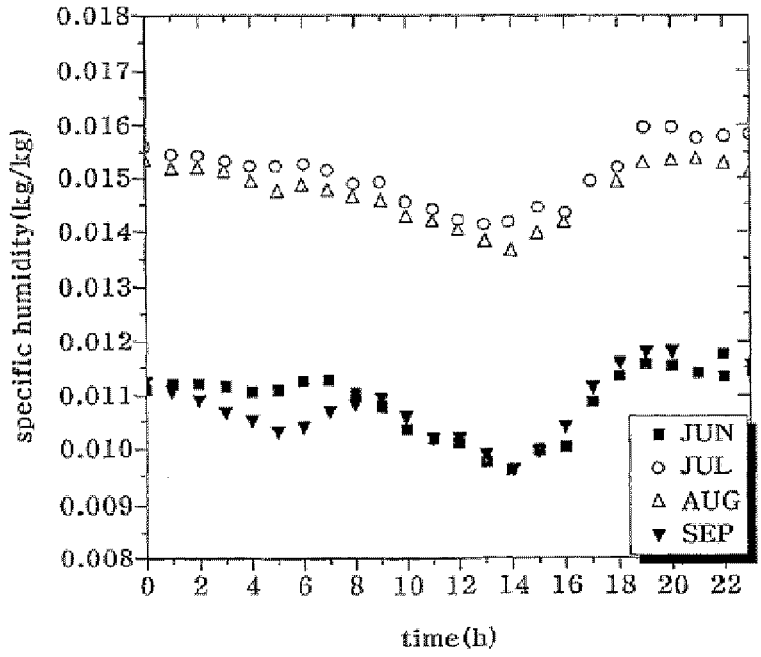
FIG. 2 is a graph showing the change of average specific humidity in Daejeon, Korea, from July to September for five years.

FIG. 2 shows the change of average specific humidity for each month from July to September for five years in Daejeon, Korea. The specific humidity is obtained from the temperature and relative humidity by using the psychrometric chart.

It is clear that the specific humidity varies very little during a day, and that June and September and July and August have similar values, respectively. The relative humidity varies little between months. However, the specific humidity varies clearly between months. Due to seasonal reasons, the specific humidity of July and August (which are hot and humid months) is higher than that of June and September by about 40%.

It is clear from FIG. 2 that the specific humidity increases from June to July, and decreases from August to September. Based on an assumption that the increase and decrease of the specific humidity are in proportion to the date, the present invention proposes the following linear correlation formula (Equation 7).

Figure 7:
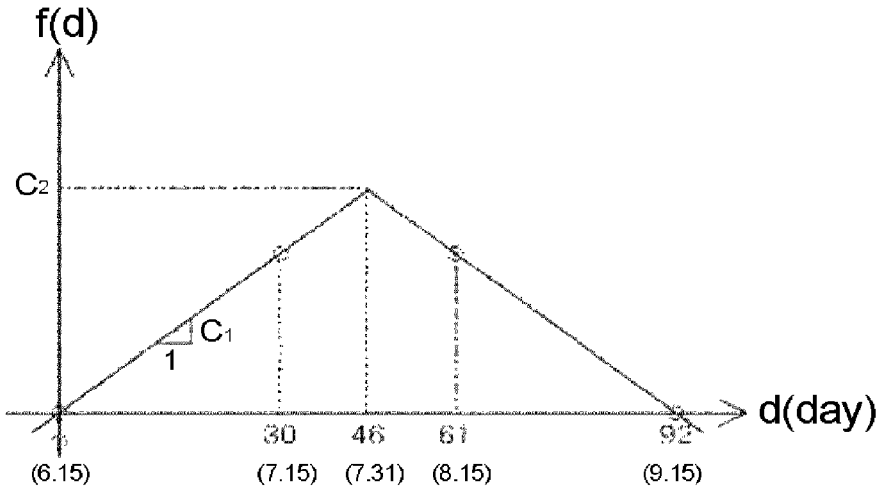
FIG. 7 shows constants $C_1$ and $C_2$ which are determined by the regional characteristics and are obtained from average specific humidity values in June, July, August, and September of a given region by using a least square method.

[Equation 7]

$$f(d)=C_1|d-46|+C_2 \qquad \text{(Equation 7)}$$

wherein, f(d) is a daily specific humidity correlation formula, d is the number of days starting from June 15, and $C_1$ and $C_2$ refer to the slope and the maximum value, respectively, as is clear from the FIG. 7. Particularly, $C_1$ and $C_2$ are constants determined by the regional characteristics, and are obtained from the average specific humidity of June, July, August, and September in each region by using the least square method.

Figure 3:
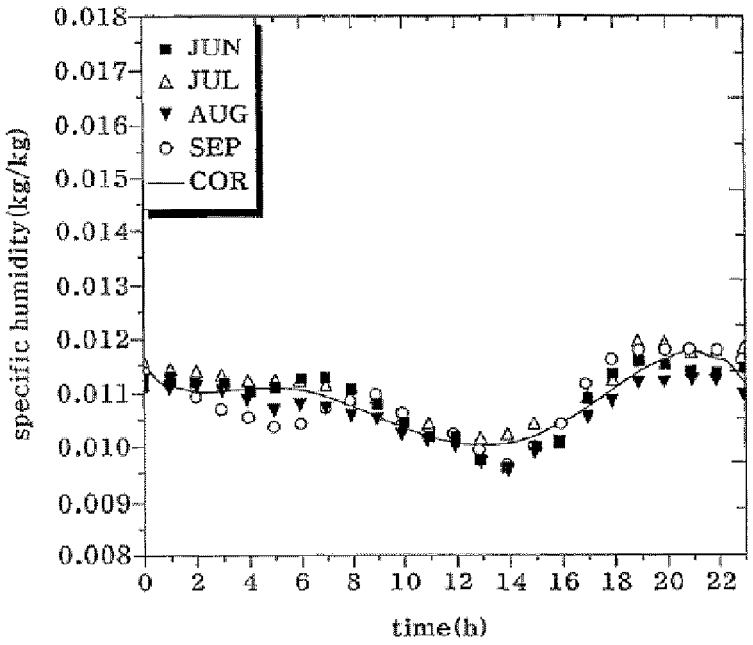
FIG. 3 is a graph showing a specific humidity correlation formula, which is obtained by adding a linear correlation formula to hourly specific humidity of each month.

Addition of Equation 7 with specified constants $C_1$ and $C_2$ to the hourly specific humidity of each month gives a graph as shown in FIG. 3, which can be formulated to a specific humidity correlation formula (Equation 9) independent of months.

It is clear from analysis of five-year data that the tendency of the outdoor air temperature and specific humidity appears regular. The nondimensional outdoor air temperature (Equation 8) and the specific humidity (Equation 9) can be expressed by the following correlation formula.

[Equation 8]

$$T^*(h)=-0.94+0.46h-0.25h^2+0.04h^3-0.003h^4+1.07E-4h^5-1.29E-6^6$$

wherein, T*(h) is the nondimensional outdoor air temperature, and h is a value of an hour hand of the day;

[Equation 9]

$$SH(h,d)=0.011-5.31E-4h+2.19E-4h^2-3.61E-6h^3+2.52E-6h^4-7.51E-8h^5+7.67E-10h^6-0.000141|d-46|+0.006375$$

wherein, SH(h,d) is a hourly specific humidity correlation formula, h is a value of an hour hand of a the day and d is the number of days starting from June 15.

The correlation formulas regarding the nondimensional outdoor air temperature and specific humidity obtained above are referred to as a temperature prediction function (Equation 8) and a specific humidity prediction function (Equation 9), respectively, in the present invention.

By substituting T*(h) in the Equation 8 and the highest and lowest temperatures of the next day forecasted by the meteorological office in following Equation 10, the outdoor air temperature for each time period can be predicted, and the specific humidity for each time period can be predicted from the above Equation 9.

[Equation 10]

$$T_{es}(h)=T_{avg}+T^*(h)(T_{max}-T_{avg})$$

wherein, $T_{es}(h)$ refers to the hourly prediction temperature of the next day; T*(h) refers to the hourly nondimensional temperature obtained from the temperature prediction function, and $T_{max}$ and $T_{avg}$ refer to the highest and average temperatures of the next day forecast, respectively.

By entering the hourly prediction temperature and specific humidity obtained above into the psychrometric chart, the enthalpy can be obtained, which is necessary to calculate the sensible heat load and latent heat load from the Equations 2 and 3, respectively.

It is necessary to know the trend of change of the cooling load during the day and the change of average daily cooling load for the cooling period, so that adaptive operation of the cooling system can be accomplished. For this, the air-conditioning design data of the target building is used to calculate the sensible heat loading coefficient, outdoor air coefficient, sensible heat load constant, and latent heat loading constant, and the predicted temperature and specific humidity are used to predict the hourly cooling load during a day in the present invention.

In order to verify the validity of the prediction technique proposed by the present invention, an experiment has been made by applying the proposed prediction technique to a building and then the results obtained from the experiment has been compared with those obtained from the actual measurement. The building selected is E hospital, which consumes a large amount of energy (i.e. requires cooling throughout the day). The construction of the building was completed in 2004 and has been operated since that time. The total area of the building is 93,854.7 $m^2$, and the building consists of 15 floors and 3 basements. In order to estimate the cooling load, the building has been designed based on an assumption that the outdoor air temperature is 31.2° C., and the relative humidity is 85%. The cooling system of the building includes two absorption type coolers having a capacity of 700 USRT, two turbo-coolers having a capacity of 780 USRT, a cold storage tank having a capacity of 10,500 USRT, three brine pumps having a capacity of 7,231 1 pm, three cooling water circulation pumps having a capacity of 9,100 1 pm, and three cold water circulation pumps having a capacity of 9,475 1 pm.

Figure 4:
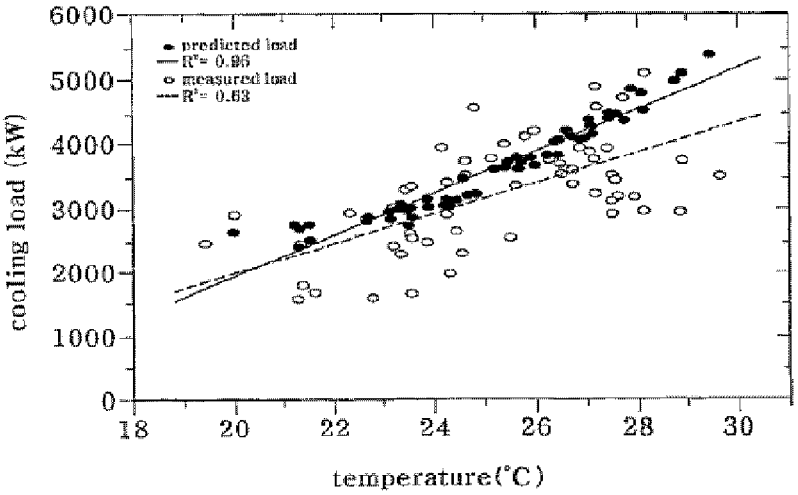
FIG. 4 is a graph showing the relation between the cooling load of E hospital and the outdoor air temperature.

FIG. 4 shows the relation between the cooling load of the model building and the outdoor air temperature. It is clear from FIG. 4 that the correlation between the daily average temperature and the cooling load is very high (96%).

Figure 5:
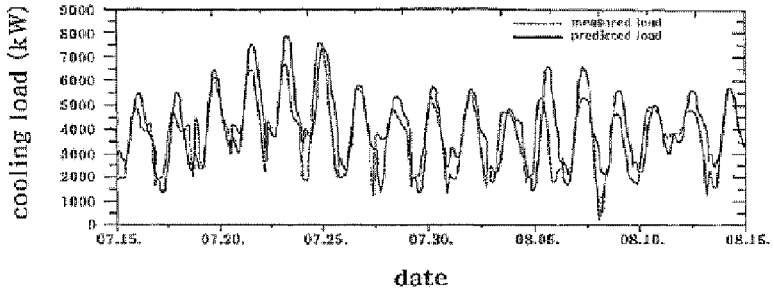
Figure 6:
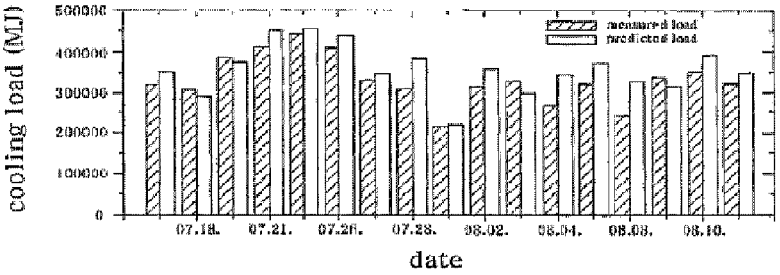

FIGS. 5 and 6 show the results of comparison between the predicted hourly cooling load and the humidity ratio and the actually measured hourly cooling load and the specific humidity respectively from Jul. 15 to Aug. 15, 2005.

It is clear from FIGS. 5 and 6 that the hourly prediction load and the total amount of predicted daily load show a tendency very similar to that of the actual load.

Only the predicted peak load (solid line) is generally larger than the actually measured peak load (dotted line), and that the predicted total amount of daily load (black bar) is also larger than the actual load (slanted line bar). This difference might be caused by the forecast error of meteorological office for the next day outdoor air temperature and other errors resulting from the fact that the cooling load prediction method does not consider the dynamic heat transfer effect.

In addition, the time of occurrence of the predicted peak load (solid line) comes later than that of the actual peak load (dotted line). This time delay might result from the fact that it takes time until the heat acquired comes to the actual cooling load.

INDUSTRIAL APPLICABILITY

As described above, the present invention provides a simplified method for predicting the cooling load in advance for cooling down a building by a cooling system equipped with a heat accumulation system, so that the cooling system can be operated effectively. The cooling load curve predicted by the proposed present invention follows the tendency of the actually measured cooling load fairly well.

It is apparent that the cooling load predicting method proposed by the present invention can be applied to any heat accumulation system.

The invention claimed is:

1. A method for predicting a cooling load of a cooling system for a building, comprising the steps of:

calculating, using the cooling system, a sensible heat load and a latent heat load, respectively, of solar radiation heat, conduction heat of the building, heat caused by infiltrated outdoor air and ventilated outdoor air of the building, and internally generated heat for every conditioned space of the building; and adding the calculated sensible heat load and latent heat load to obtain the cooling load of the cooling system for the building so that the cooling system is run at the obtained cooling load, wherein the sensible heat load of the cooling load is calculated by $$\dot{Q}_s = P_s(T_o - T_i) + \dot{m}_s(h_{io} - h_i)(1 - \epsilon_s) + C_s \quad (1)$$

wherein, $\dot{Q}_s$ is the sensible heat load, $P_s$ is a sensible heat load coefficient, $\dot{m}_a$ is an outdoor air coefficient, $C_s$ is a sensible heat load constant, $T_o$ is an outdoor air temperature, $T_i$ is an indoor temperature, $h_{io}$ is enthalpy of air at a point where an indoor specific humidity meets the outdoor air temperature on a psychrometric chart, $h_i$ is enthalpy of air in an indoor condition, and $\epsilon s$ is a sensible heat recovery ratio of infiltrated and ventilated air, and wherein the latent heat load of the cooling load is calculated by $$\dot{Q}_l = \dot{m}_a(h_o - h_{io})(1 - \epsilon_l) + C_l \quad (2)$$

wherein, $\dot{Q}_l$ is the latent heat load, $\dot{m}_a$ is the outdoor air coefficient, $C_l$ is a latent heat load constant, $h_o$ is an enthalpy of air in an outdoor air condition, $h_{io}$ is the enthalpy of air at the point where indoor specific humidity meets the outdoor air temperature on the psychrometric chart, and $\epsilon_l$ is a latent heat recovery ratio of infiltrated and ventilated air.

2. The method as claimed in claim 1, (i) wherein the calculation by the equation (1) is performed by providing the sensible heat load coefficient $P_s$ to the cooling system for the building, wherein the sensible heat load coefficient $P_s$ is obtained from $$\dot{Q}_{s,d} = P_s(T_{o,d} - T_{i,d}) + \dot{m}_a(h_{io,d} - h_{i,d})(1 - \epsilon_{s,d}) + C_s \quad (3)$$

wherein, a design sensible heat load $\dot{Q}_{s,d}$, the outdoor air coefficient $\dot{m}_a$, the sensible heat load constant $C_s$, an outdoor air design temperature $T_{o,d}$, an indoor design temperature $T_{i,d}$, an enthalpy $h_{io,d}$ of air at a point where indoor design specific humidity meets outdoor air design temperature on the psychrometric chart, an enthalpy $h_{i,d}$ of air in an indoor design condition, and a design sensible heat recovery ratio $\epsilon_{s,d}$ of infiltrated and ventilated air are obtained from given design specifications of the building and provided to the cooling system for the building, and (ii) wherein the calculation by the equation (2) is performed by providing the latent heat load constant $C_l$ to the cooling system for the building, wherein the latent heat load constant $C_l$ is obtained from $$\dot{Q}_{l,d} = \dot{m}_a(h_{o,d} - h_{io,d})(1 - \epsilon_{l,d}) + C_l \quad (4)$$

wherein, a design latent heat load $\dot{Q}_{l,d}$, the outdoor air coefficient $\dot{m}_a$, the enthalpy $h_{o,d}$ of air in the outdoor air design condition, the enthalpy $h_{io,d}$ of air at the point where the indoor design specific humidity meets the outdoor air design temperature on the psychrometric chart, and a design latent heat recovery ratio $\epsilon_{l,d}$ of infiltrated and ventilated air are obtained from the given design specifications of the building and provided to the cooling system for the building.

3. The method as claimed in claim 1, (i) wherein the calculation by the equation (1) is performed by providing the sensible heat load coefficient $P_s$ the cooling system for the building, wherein the sensible heat load coefficient $P_s$ is obtained from $$\dot{Q}_{s,d}=P_s(T_{o,d}-T_{i,d})+\dot{m}_a(h_{io,d}-h_{i,d})(1-\epsilon_{s,d})+C_s \quad (5)$$

wherein, a design sensible heat load $\dot{Q}_{s,d}$, the outdoor air coefficient $\dot{m}_a$, the sensible heat load constant $C_s$, an outdoor air design temperature $T_{o,d}$, an indoor design temperature $T_{i,d}$, the enthalpy $h_{io,d}$ of air at a point where indoor design specific humidity meets the outdoor air design temperature on the psychrometric chart, an enthalpy $h_{i,d}$ of air in an indoor design condition, and a design sensible heat recovery ratio $\epsilon_{s,d}$ of infiltrated and ventilated air are obtained from given design specifications of the building and provided to the cooling system for the building, and (ii) wherein the calculation by the equation (2) is performed by providing the latent heat load constant $C_l$ to the cooling system for the building, wherein the latent heat load constant $C_l$ is directly obtained from the given design specifications of the building and provided to the cooling system for the building.

4. The method as claimed in claim 1, wherein, in order to obtain the outdoor air temperature $T_o$ and the specific humidity necessary to calculate enthalpy of the outdoor air $h_o$, the method further comprising the steps of (i) setting a highest and a lowest temperatures of an average outdoor air temperature as 1 and −1, respectively, (ii) obtaining a non-dimensional outdoor air temperature T*(h) by using the nondimensional equation (6) below $$T^*(h)=\frac{T(h)-T_{avg}}{T_{max}-T_{avg}},\ 0\le T^*(h)\le 1 \text{ wherein,} \quad (6)$$

T*(h) is the nondimensional outdoor air temperature,

T(h) is the outdoor air temperature at a given time, $T_{max}$ is the highest temperature during a given day, and $T_{avg}$ is an arithmetic mean of the highest and the lowest temperatures during the given day, and (iii) obtaining a temperature prediction function using the equation (7) below $$T^*(h)=-0.94+0.46h-0.25h^2+0.04h^3-0.003h^4+1.07E-4h^5-1.29E-6h^6 \quad (7)$$

wherein,

T*(h) is the nondimensional outdoor air temperature and h is a value of an hour hand at the given time of the given day, (iv) obtaining a monthly average specific humidity using relative humidity and the outdoor air temperature at the given time in reference to the psychrometric chart, (v) obtaining the linear correlation equation (8) below $$f(d)=C_1|d-46|+C_2 \quad (8)$$

wherein, f(d) is a daily specific humidity correlation function, d is a number of days counted from June 15 to the given day, and $C_1$ and $C_2$ are constants determined by regional characteristics, so that increase and decrease of the daily specific humidity is proportional to a passage of days counted from June 15 to the given day, and (vi) adding the daily specific linear correlation function □ and an hourly specific humidity of each month to obtain a hourly specific humidity prediction function SH(h,d) represented by equation (9) below $$SH(h,d)=0.011-5.31E-4h+2.19E-4h^2-3.61E-6h^3+2.52E-6h^4-7.51E-8h^5+7.67E-10h^6-0.000141|d-46|+0.006375 \quad (9)$$

wherein,

SH(h,d) is the hourly specific humidity prediction function, h is the value of an hour hand at the given time of the given day, and d is the number of days counted from June 15 to the given day;

(vii) obtaining the highest and the lowest temperatures of the next day of the given day from a meteorological office, (viii) obtaining a hourly prediction temperature $T_{es}(h)$ of next day using the highest and the lowest temperatures and the prediction temperature equation (10) represented below $$T_{es}(h)=T_{avg}+T^*(h)(T_{max}-T_{avg}) \quad (10)$$

wherein, $T_{es}(h)$ is the hourly prediction temperature,

T*(h) is the nondimensional temperature obtained from the equation (6), and $T_{max}$ and $T_{avg}$ are the highest temperature and an average temperature of next day, respectively, (ix) obtaining a hourly prediction specific humidity during the next day using the hourly specific humidity prediction function represented by the equation (9), and (x) providing the hourly prediction temperature $T_{es}(h)$ obtained in the step (viii) to the cooling system for the building as the outdoor air temperature $T_o$ and providing the hourly prediction specific humidity obtained in the step (ix) to the cooling system for the building as the specific humidity so that the cooling system for the building can perform the calculation represented by the equation (2).

* * * * *